US011014112B2

(12) United States Patent
Molz et al.

(10) Patent No.: US 11,014,112 B2
(45) **Date of Patent: *May 25, 2021**

(54) THERMO SPRAY GUN WITH REMOVABLE NOZZLE TIP AND METHOD MAKING AND USING THE SAME

(75) Inventors: Ronald J. Molz, Mt. Kisco, NY (US); Dave Hawley, Westbury, NY (US); Richard McCullough, Brooklyn, NY (US)

(73) Assignee: OERLIKON METCO (US) INC., Westbury, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/361,958

(22) PCT Filed: Jan. 27, 2012

(86) PCT No.: PCT/US2012/022906

§ 371 (c)(1),
(2), (4) Date: May 30, 2014

(87) PCT Pub. No.: WO2013/112178

PCT Pub. Date: Aug. 1, 2013

(65) Prior Publication Data

US 2014/0329020 A1 Nov. 6, 2014

(51) Int. Cl.
*B05B 7/22* (2006.01)
*H05H 1/34* (2006.01)
(Continued)

(52) U.S. Cl.
CPC ..... *B05B 13/0278* (2013.01); *B05B 1/12* (2013.01); *B05B 7/22* (2013.01); *B05B 7/222* (2013.01);
(Continued)

(58) Field of Classification Search
None
See application file for complete search history.

(56) References Cited

U.S. PATENT DOCUMENTS 3,851,824 A 12/1974 Svensson
3,914,573 A 10/1975 Muehlberger
(Continued)

FOREIGN PATENT DOCUMENTS

JP 60-31358 3/1985
JP 62-197275 8/1987
(Continued)

OTHER PUBLICATIONS

International Search Report (dated May 15, 2012) and Written Opinion (dated Aug. 7, 2014) issued in counterpart International Application No. PCT/US2012/022906.
(Continued)

*Primary Examiner* — Binu Thomas
(74) *Attorney, Agent, or Firm* — Greenblum & Bernstein, P.L.C.

(57) ABSTRACT

A thermo spray gun (10) includes at least one of; at least one removable nozzle tip (20) for spraying a coating material, at least one replaceable nozzle tip (20) for spraying a coating material, and at least one interchangeable nozzle tip (20) for spraying a coating material. A thermo spray gun system (1000) includes a thermal spray gun (10) and at least one mechanism (30/40) at least one of; storing at least one nozzle tip installable on the thermal spray gun and being structured and arranged to install at least one nozzle tip on the thermal spray gun. A method of coating a substrate (S) using a thermo spray gun (10) includes mounting at least one nozzle tip (20) on the thermo spray gun (10) and spraying a coating material with the at least one nozzle tip (20).

25 Claims, 12 Drawing Sheets

(51) Int. Cl.

| | |
|---|---|
| ***H05H 1/28*** | (2006.01) |
| ***C23C 4/134*** | (2016.01) |
| ***B05B 13/02*** | (2006.01) |
| ***B05B 15/65*** | (2018.01) |
| ***B05B 13/04*** | (2006.01) |
| ***B05B 1/12*** | (2006.01) |
| ***C23C 4/131*** | (2016.01) |
| ***C23C 4/00*** | (2016.01) |
| *B05B 1/16* | (2006.01) |

(52) U.S. Cl.
CPC ..... *B05B 13/0431* (2013.01); *B05B 15/65* (2018.02); *C23C 4/00* (2013.01); *C23C 4/131* (2016.01); *C23C 4/134* (2016.01); *H05H 1/28* (2013.01); *H05H 1/34* (2013.01); *B05B 1/1654* (2013.01)

(56) References Cited

U.S. PATENT DOCUMENTS

| | | | | |
|---|---|---|---|---|
| 4,437,610 | A * | 3/1984 | Huber | B05B 15/065 239/119 |
| 4,506,136 | A * | 3/1985 | Smyth | H05H 1/34 219/121.47 |
| 4,688,722 | A * | 8/1987 | Dellassio | H05H 1/34 239/132.3 |
| 4,780,591 | A * | 10/1988 | Bernecki | H05H 1/3405 219/121.48 |
| 4,958,057 | A * | 9/1990 | Shiraishi | H05H 1/34 219/121.48 |
| 5,144,110 | A | 9/1992 | Marantz | |
| 5,444,209 | A * | 8/1995 | Crawmer | H05H 1/34 219/121.47 |
| 5,458,388 | A | 10/1995 | Danek | |
| 5,519,183 | A | 5/1996 | Muellar | |
| 6,085,996 | A | 7/2000 | Culbertson | |
| 6,698,617 | B1 * | 3/2004 | Szymanski | B05B 15/065 222/575 |
| 7,045,738 | B1 | 5/2006 | Kovacevic | |
| 7,578,451 | B2 | 8/2009 | Muellar | |
| 7,759,599 | B2 | 7/2010 | Hawley | |
| 9,142,390 | B2 | 9/2015 | Savill, Jr. | |
| 2004/0005413 | A1 | 1/2004 | Li | |
| 2006/0049149 | A1 | 3/2006 | Shimazu | |
| 2007/0084834 | A1 * | 4/2007 | Hanus | H05H 1/34 219/121.5 |

FOREIGN PATENT DOCUMENTS

| | | |
|---|---|---|
| JP | 5-76671 | 10/1993 |
| JP | 9-308970 | 12/1997 |
| JP | 11-333654 | 12/1999 |
| JP | 2000-351090 | 12/2000 |
| JP | 2006-55708 | 3/2006 |
| JP | 2006-218476 | 8/2006 |

OTHER PUBLICATIONS

Search Report/Office Action dated Aug. 27, 2015 issued in EP Application No. 12866811.
Japanese Office Action dated Apr. 1, 2016 and issued in Japanese Application No. 2014-554702 (3 pages).
Australian Office Action dated Mar. 1, 2016 and issued in Australia Application No. 2012367305 (5 pages).
EP Office Action issued in EP 12 866 811 and dated Jan. 24, 2017.
Japanese Office Action (with Translation) dated Dec. 13, 2016 and issued in Japanese Application No. 2014-554702 (6 pages).
European Search Report dated Jan. 25, 2017 and issued in EP Application No. 16181291.2 (7 pages).
Chinese Office Action (and English translation) issued in CN 201280066909.6 dated Feb. 2018.
Chinese Office Action issued in CN 201280066909.6 dated Apr. 5, 2017.

* cited by examiner

THERMO SPRAY GUN WITH REMOVABLE NOZZLE TIP AND METHOD MAKING AND USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

With the advent of plasma guns having wide operating ranges through the use of different plasma forming nozzles (see, e.g., ITSC 2005 technical paper on plasma forming nozzles for Triplex), the ability of a plasma gun to produce a wide array of thermal spray coatings became possible. One example is the application of thermal barriers where two coating layers are required. In such barrier coatings, the first layer is a bonding layer typically comprised of an MCrAlY type superalloy material that is applied at high particle velocities and relatively low particle temperatures. The second coating is a ceramic thermal barrier applied at low particle velocities and high particle temperatures. In applying such coatings, two different plasma nozzles are utilized. One nozzle is a high enthalpy straight bore nozzle. The other is a high velocity laval type nozzle.

In order to produce such a complete coating system, either two separate guns are required or two spray cells must be utilized, or, at best, the gun hardware needs to be manually changed—which requires interrupting the coating process. In fact, current systems require manual disassembly of at least part of the gun to change the hardware, and more specifically the nozzle, in order to change the operating regime of the gun. Also known in the art is the ability to automatically change entire guns with each gun configured with the appropriate gun hardware for the required operating regime. This method entails considerable additional hardware and capital expense for switching the high energy and gas utility feeds to the "active" gun.

What is needed is a thermo spray gun with interchangeable nozzle tips and/or a method for automatically changing plasma gun nozzles (or nozzle tips) to facilitate changing the operating regime of the gun to suit the various applications for multi-layer coating systems.

SUMMARY OF THE INVENTION

In accordance with one non-limiting embodiment, there is provided a thermo spray gun or system which overcome one or more of the disadvantages of conventional systems.

In accordance with one non-limiting embodiment, there is provided a thermo spray gun comprising at least one of: at least one removable nozzle tip for spraying a coating material, at least one replaceable nozzle tip for spraying a coating material, and at least one interchangeable nozzle tip for spraying a coating material.

In embodiments, the nozzle tip is mechanically coupled to an anode section of the thermo spray gun.

In embodiments, the nozzle tip is electrically coupled to an anode section of the thermo spray gun.

In embodiments, the nozzle tip is removable from the thermo spray gun while an anode section remains coupled to the thermo spray gun.

In embodiments, the nozzle tip is removable from the thermo spray gun with an anode section.

In embodiments, the nozzle tip includes an anode section of the thermo spray gun.

In embodiments, the thermal spray gun is one of a plasma spray gun and a HVOF (High Velocity Oxygen Fuel) spray gun.

In embodiments, the thermo spray gun further comprises at least one feedstock supply line coupled to a portion of the thermo spray gun.

In embodiments, the thermo spray gun further comprises a robot, wherein the thermo spray gun is mounted to an arm of the robot.

In embodiments, the thermo spray gun is utilized in combination with a station or location storing a plurality of nozzle tips.

In embodiments, the thermal spray gun is utilized in combination with a station or location storing a plurality of different nozzle tips.

In embodiments, the thermal spray gun is utilized in combination with a station or location storing a plurality of nozzle tips arranged at a predetermined location that is different from a location containing a substrate being sprayed with the coating material.

In accordance with one non-limiting embodiment, there is provided a thermo spray gun system comprising a thermal spray gun and at least one mechanism at least one of; storing at least one nozzle tip installable on the thermal spray gun and being structured and arranged to install at least one nozzle tip on the thermal spray gun.

In embodiments, the system further comprises a control controlling at least one of; movement of the thermal spray gun and installation of the at least one nozzle tip installable on the thermal spray gun.

In embodiments, the at least one nozzle tip is at least one of; at least one removable nozzle tip for spraying a coating material, at least one replaceable nozzle tip for spraying a coating material, and at least one interchangeable nozzle tip for spraying a coating material.

In embodiments, the system further comprises a robot, wherein the thermo spray gun is mounted to an arm of the robot.

In embodiments, the system is utilized in combination with a station or location storing the at least one mechanism.

In embodiments, the system further comprises a robot, wherein the thermo spray gun is mounted to an arm of the robot and a control controlling at least one of; movement of the thermal spray gun and installation of the at least one nozzle tip installable on the thermal spray gun.

In embodiments, the system further comprises a robot, wherein the thermo spray gun is mounted to an arm of the robot and a control controlling at least one of; programmed movement of the thermal spray gun and programmed or automatic installation of the at least one nozzle tip installable on the thermal spray gun.

In embodiments, the system further comprises a robot, wherein the thermo spray gun is mounted to an arm of the robot and a control controlling movement of the thermal spray gun and installation of the at least one interchangeable nozzle tip on the thermal spray gun.

In accordance with one non-limiting embodiment, there is provided a thermo spray gun system comprising a thermal spray gun and at least one mechanism comprising at least first and second nozzle tips and being movable between; a first position wherein the first nozzle nip is utilized to spray a coating material and a second position wherein the second nozzle nip is utilized to spray a coating material.

In embodiments, the system further comprises a control controlling at least one of; movement of the thermal spray gun and movement of the at least one mechanism between the first and second positions.

In embodiments, the system further comprises a robot, wherein the thermo spray gun is mounted to an arm of the robot.

In embodiments, the system is utilized in combination with a station or location storing the at least one mechanism.

In embodiments, the system is utilized in combination with a station or location storing a plurality of the at least one mechanism.

In embodiments, the system further comprises a robot, wherein the thermo spray gun is mounted to an arm of the robot and a control controlling movement of the at least one mechanism between the first and second positions.

In embodiments, the system further comprises a robot, wherein the thermo spray gun is mounted to an arm of the robot and a control controlling at least one of, programmed movement of the thermal spray gun and programmed movement of the at least one mechanism between the first and second positions.

In embodiments, the system further comprises a robot, wherein the thermo spray gun is mounted to an arm of the robot and a control controlling movement of the thermal spray gun and movement of the at least one mechanism between the first and second positions.

In accordance with one non-limiting embodiment, there is provided a method of coating a substrate using a thermo spray gun, wherein the method comprises mounting at least one nozzle tip on the thermo spray gun and spraying a coating material with the at least one nozzle tip.

In accordance with one non-limiting embodiment, there is provided a method of coating a substrate using a thermo spray gun, wherein the method comprises removably mounting at least one nozzle tip on the thermo spray gun and spraying a coating material with the at least one nozzle tip.

In accordance with one non-limiting embodiment, there is provided a method of coating a substrate using a thermo spray gun, wherein the method comprises mounting at least one nozzle tip on the thermo spray gun, spraying a coating material with the at least one nozzle tip, removing the at least one nozzle tip from the thermal spray gun, and mounting another at least one nozzle tip on the thermo spray gun.

In accordance with one non-limiting embodiment, there is provided a method of coating a substrate using a thermo spray gun, wherein the method comprises moving the thermo spray gun to a predetermined location and mounting at least one nozzle tip on the thermo spray gun.

In accordance with one non-limiting embodiment, there is provided a method of coating a substrate using a thermo spray gun, wherein the method comprises spraying a coating material with the at least one nozzle tip, moving the thermo spray gun to a predetermined location, and removing the at least one nozzle tip from the thermal spray gun.

In accordance with one non-limiting embodiment, there is provided a method of coating a substrate using a thermo spray gun, wherein the method comprises automatically moving the thermo spray gun to a predetermined location and automatically removing the at least one nozzle tip from the thermal spray gun.

In accordance with one non-limiting embodiment, there is provided a method of coating a substrate using a thermo spray gun, wherein the method comprises automatically moving the thermo spray gun to a predetermined location and automatically installing at least one nozzle tip onto the thermal spray gun.

In accordance with one non-limiting embodiment, there is provided a method of coating a substrate using a thermo spray gun, wherein the method comprises automatically moving the thermo spray gun to a predetermined location, automatically removing the at least one nozzle tip onto the thermal spray gun, and automatically installing another at least one nozzle tip onto the thermal spray gun.

In accordance with one non-limiting embodiment, there is provided a method of coating a substrate using a thermo spray gun, wherein the method comprises spraying a coating material with the at least one nozzle tip, moving the thermo spray gun to a predetermined location, removing the at least one nozzle tip onto the thermal spray gun, installing an other at least one nozzle tip onto the thermal spray gun, and spraying a coating material with the other at least one nozzle tip.

In accordance with one non-limiting embodiment, there is provided a method of coating a substrate using a thermo spray gun, wherein the method comprises spraying in a controlled manner a coating material with the at least one nozzle tip, moving in a controlled manner the thermo spray gun to a predetermined location, removing in a controlled manner the at least one nozzle tip onto the thermal spray gun, installing in a controlled manner an other at least one nozzle tip onto the thermal spray gun, and spraying in a controlled manner a coating material with the other at least one nozzle tip.

In accordance with one non-limiting embodiment, there is provided a method of coating a substrate using a thermo spray gun, wherein the method comprises spraying a coating material with the at least one nozzle tip, automatically moving the thermo spray gun to a predetermined location, automatically removing the at least one nozzle tip onto the thermal spray gun, automatically installing an other at least one nozzle tip onto the thermal spray gun, and spraying a coating material with the other at least one nozzle tip.

The invention also relates to a thermal spray gun comprising an internal cathode section, an internal anode section and at least one of at least one removable nozzle tip for spraying a coating material and being disposed in front of the cathode section and the anode section, at least one replaceable nozzle tip for spraying a coating material and being disposed in front of the cathode section and the anode section, and at least one interchangeable nozzle tip for spraying a coating material and being disposed in front of the cathode section and the anode section, wherein said nozzle tip comprises an engageable portion configured to be externally gripped while the cathode section and the anode section remain disposed inside the thermal spray gun that, when installed, at least one of: extends outside the thermal spray gun and is directly accessible from outside the thermal spray gun for removing, replacing and/or interchanging said nozzle tip without manual disassembly of at least part of the thermal spray gun and/or is directly grippable from outside the thermal spray gun for removing, replacing and/or interchanging said nozzle tip without manual disassembly of at least part of the thermal spray gun.

In embodiments, the nozzle tip is mechanically coupled to an anode section of the thermal spray gun.

In embodiments, the nozzle tip is electrically coupled to an anode section of the thermal spray gun.

In embodiments, the nozzle tip is removable from the thermal spray gun while an anode section remains coupled to the thermal spray gun.

In embodiments, the nozzle tip is removable from the thermal spray gun with an anode section.

In embodiments, the nozzle tip includes an anode section of the thermal spray gun.

In embodiments, the thermal spray gun is one of a plasma spray gun and an HVOF spray gun.

In embodiments, the thermal spray gun may further comprise at least one feedstock supply line coupled to a portion of the thermal spray gun.

In embodiments, the thermal spray gun may further comprise a robot, wherein the thermal spray gun is mounted to an arm of the robot.

In embodiments, the thermal spray gun is in combination with a station or location storing a plurality of nozzle tips.

In embodiments, the thermal spray gun is in combination with a station or location storing a plurality of different nozzle tips.

In embodiments, the thermal spray gun is in combination with a station or location storing a plurality of nozzle tips arranged at a predetermined location that is different from a location containing a substrate being sprayed with the coating material.

The invention also provides for a thermal spray gun system comprising a thermal spray gun and at least one mechanism at least one of storing at least one nozzle tip installable on the thermal spray gun and being structured and arranged to install at least one nozzle tip on the thermal spray gun, wherein said nozzle tip is directly accessible for automated removal when installed on the thermal spray gun and without manual disassembly of at least part of the thermal spray gun.

In embodiments, the system may further comprise a control controlling at least one of: movement of the thermal spray gun and installation of the at least one nozzle tip installable on the thermal spray gun.

In embodiments, the at least one nozzle tip is at least one of: at least one removable nozzle tip for spraying a coating material, at least one replaceable nozzle tip for spraying a coating material, and at least one interchangeable nozzle tip for spraying a coating material.

In embodiments, the system may further comprise a robot, wherein the thermal spray gun is mounted to an arm of the robot.

In embodiments, the system is in combination with a station or location storing the at least one mechanism.

In embodiments, the system may further comprise a robot, wherein the thermal spray gun is mounted to an arm of the robot and a control controlling at least one of movement of the thermal spray gun and installation of the at least one nozzle tip installable on the thermal spray gun.

In embodiments, the system may further comprise a robot, wherein the thermal spray gun is mounted to an arm of the robot and a control controlling at least one of programmed movement of the thermal spray gun and programmed or automatic installation of the at least one nozzle tip installable on the thermal spray gun.

In embodiments, the system may further comprises a robot, wherein the theinial spray gun is mounted to an arm of the robot and a control controlling movement of the thermal spray gun and installation of the at least one interchangeable nozzle tip on the thermal spray gun.

The invention also provides for a thermal spray gun system comprising a thermal spray gun and at least one mechanism comprising at least first and second nozzle tips and being movable between a first position wherein the first nozzle nip is utilized to spray a coating material and a second position wherein the second nozzle nip is utilized to spray a coating material, wherein said first and second nozzle tips are each directly accessible for removal when respectively installed on the thermal spray gun and without manual disassembly of at least part of the thermal spray gun.

In embodiments, the system may further comprises a control controlling at least one of movement of the thermal spray gun and movement of the at least one mechanism between the first and second positions.

In embodiments, the system may further comprises a robot, wherein the thermal spray gun is mounted to an arm of the robot.

In embodiments, the system is in combination with a station or location storing the at least one mechanism.

In embodiments, the system in combination with a station or location storing a plurality of the at least one mechanism.

In embodiments, the system may further comprise a robot, wherein the thermal spray gun is mounted to an arm of the robot and a control controlling movement of the at least one mechanism between the first and second positions.

In embodiments, the system may further comprise a robot, wherein the thermal spray gun is mounted to an arm of the robot and a control controlling at least one of programmed movement of the thermal spray gun and programmed movement of the at least one mechanism between the first and second positions.

In embodiments, the system may further comprise a robot, wherein the thermal spray gun is mounted to an arm of the robot and a control controlling movement of the thermal spray gun and movement of the at least one mechanism between the first and second positions.

The invention also provides for a method of coating a substrate using a thermal spray gun, comprising mounting at least one nozzle tip on the thermal spray gun and spraying a coating material with the at least one nozzle tip.

The invention also provides for a method of coating a substrate using a thermal spray gun, comprising removably mounting at least one nozzle tip on the thermal spray gun and spraying a coating material with the at least one nozzle tip.

The invention also provides for a method of coating a substrate using a thermal spray gun, comprising mounting at least one nozzle tip on the theinial spray gun, spraying a coating material with the at least one nozzle tip, removing the at least one nozzle tip from the thermal spray gun and mounting another at least one nozzle tip on the thermal spray gun.

The invention also provides for a method of coating a substrate using a thermal spray gun, comprising moving the thermal spray gun to a predetermined location and mounting at least one nozzle tip on the thermal spray gun.

The invention also provides for a method of coating a substrate using a thermal spray gun, comprising spraying a coating material with the at least one nozzle tip, moving the thermal spray gun to a predetermined location and removing the at least one nozzle tip from the thermal spray gun.

The invention also provides for a method of coating a substrate using a thermal spray gun, comprising automatically moving the thermal spray gun of claim 1 to a predetermined location and automatically removing the at least one nozzle tip from the thermal spray gun.

The invention also provides for a method of coating a substrate using a thermal spray gun, comprising automatically moving the theinial spray gun of claim 1 to a predetermined location and automatically installing at least one nozzle tip onto the thermal spray gun.

The invention also provides for a method of coating a substrate using a thermal spray gun, comprising automatically moving the thermal spray gun of claim 1 to a predetermined location, automatically removing the at least one nozzle tip onto the thermal spray gun and automatically installing another at least one nozzle tip onto the thermal spray gun.

The invention also provides for a method of coating a substrate using a thermal spray gun, comprising spraying a coating material with the at least one nozzle tip, moving the thei mai spray gun to a predetermined location, removing the at least one nozzle tip onto the thermal spray gun, installing an other at least one nozzle tip onto the thermal spray gun, and spraying a coating material with the other at least one nozzle tip.

The invention also provides for a method of coating a substrate using a thermal spray gun, comprising spraying in a controlled manner a coating material with the at least one nozzle tip, moving in a controlled manner the thermal spray gun to a predetermined location, removing in a controlled manner the at least one nozzle tip onto the thermal spray gun, installing in a controlled manner an other at least one nozzle tip onto the theiinal spray gun and spraying in a controlled manner a coating material with the other at least one nozzle tip.

The invention also provides for a method of coating a substrate using a thermal spray gun, comprising spraying a coating material with the at least one nozzle tip, automatically moving the thermal spray gun to a predetermined location, automatically removing the at least one nozzle tip onto the thermal spray gun, automatically installing an other at least one nozzle tip onto the thermal spray gun and spraying a coating material with the other at least one nozzle tip.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted drawings by way of a non-limiting example embodiment of the present invention, and wherein.

DETAILED DESCRIPTION OF THE INVENTION

Figure 1:
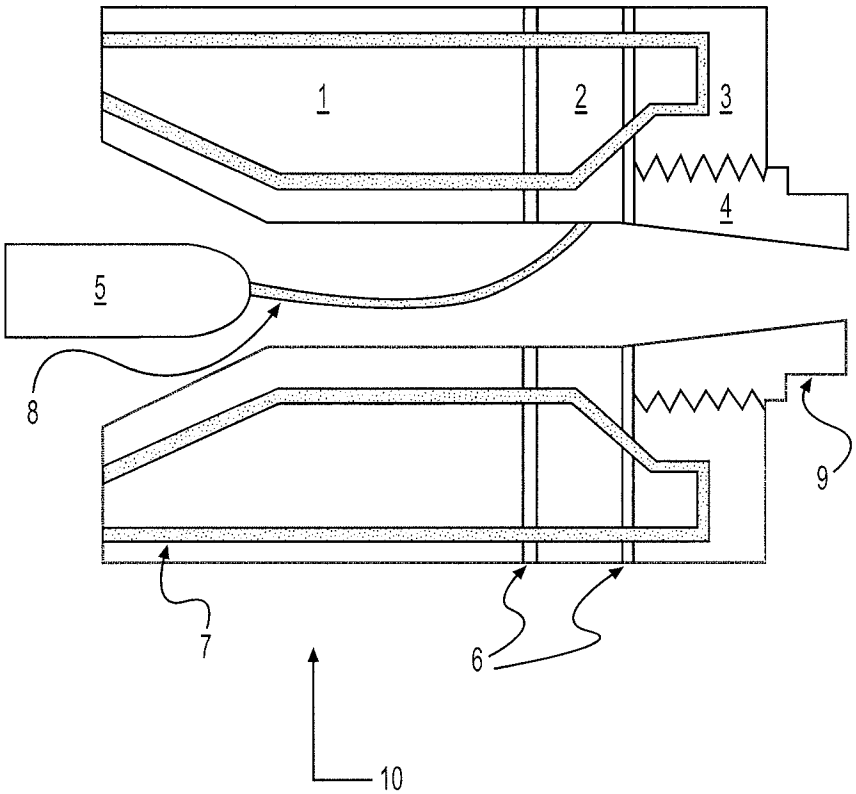
FIG. 1 shows a side cross-section schematic view of a thermo spray gun having a thread-on nozzle tip in accordance with one non-limiting embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In accordance with one non-limiting embodiment of the invention, there is provided a thermo spray gun 10 which includes at least one of: at least one removable nozzle tip 4 for spraying a coating material, at least one replaceable nozzle tip 4 for spraying a coating material, and at least one interchangeable nozzle tip 4 for spraying a coating material.

In accordance with another non-limiting embodiment, there is provided a thermo spray gun system 1000 comprising a thermal spray gun 10 and at least one mechanism 30 comprising at least first and second nozzle tips 20 and being movable between a first position wherein the first nozzle nip is utilized to spray a coating material and a second position wherein the second nozzle nip is utilized to spray a coating material.

In accordance with still another non-limiting embodiment, there is provided a thermo spray gun system 1000 comprising a thermal spray gun 10 and at least one mechanism, e.g., support 30 and/or fixture 40, at least one of storing at least one nozzle tip 20 installable on the thermal spray gun 10 and being structured and arranged to install at least one nozzle tip 20 on the thermal spray gun 10. Such a system is preferably an automated system.

With an automated interchangeable nozzle system 2000, the processing of complex coating systems with different layered materials can be undertaken in one process step or station 30 without the need for manual hardware changes and the lost production time associated with manual intervention. In addition the time between layer applications is reduced and this can lead to improved adhesion between the layers and overall coating quality.

With reference to FIG. 1, there is schematically shown a plasma gun 10 with extended operating capability and that is configured with a separate anode or current carrying section and a nozzle or plasma forming section. The current carrying section includes neutral section 1, anode section 2, nozzle base 3, cathode 5 which generates an electric arc 8, electrically insulated and water-tight seals 6, and cooling water channel 7. The nozzle or plasma forming section constitutes a nozzle insert 4 which can be thread into and out of the nozzle base 3. In this case, external threads are arranged on the nozzle tip 4 which engage with internal threads of the nozzle base 3. The anode section 2 serves as the positive or + connection for the plasma arc 8 inside the gun bore and may have a discontinuity or groove to affect seating of the arc 8 at the anode section 2. The nozzle tip 4 determines the operating regime of the plasma gun 10 and can have different geometries and lengths. Thus, for example, one nozzle tip 4 can have a geometry or configuration for one coating type or spray pattern and another nozzle tip 4 can have a different geometry or configuration for a different coating type or spray pattern. Both nozzle tips can, however, have the same interface section (e.g., same size external threads) so as to both be able to be mounted onto the same plasma gun 10.

The embodiment of FIG. 1 can also be modified to utilize a nozzle constituting two components or parts. The first part can have the form of a water cooled base 3 that is assembled or mounted into or onto the gun 10 and that has a threaded receptacle or nozzle tip receiving interface. The nozzle insert or tip 4 that has a specific geometry to determine the operating regime of the plasma gun can then be threaded into the nozzle base 3 to operate the gun. In this embodiment, the nozzle base 3 can optionally be removable from the plasma gun 10 with the nozzle tip 4.

To facilitate easy or automatic removal or installation of the nozzle tip 4, an exposed outer section or diameter 9 of the nozzle insert or tip 4 is configured to be gripped. In embodiments, this section 9 can optionally have a groove (not shown) into which a gripping device, e.g., a collet or chuck type gripping device, can grip or grab the nozzle insert 4. The collet or chuck can preferably be driven by a spindle or motor so that it can rotate the gripped nozzle tip 4. For example, the gripping device can grip the section 9 of the tip 4 and rotate it in one direction so as to unscrew it (and remove it) from the plasma gun 10 and rotate it in an opposite direction to screw the nozzle tip 4 into the nozzle base 3 (and installed the same). When the gripping device is used in an automated context, the gripping device (gripping section 9) and plasma gun 10 have their movements coordinated so that one nozzle tip 4 is removed from the plasma gun 10 and another is installed on the plasma gun 10 in a controlled or pre-programmed way. In embodiments, the gripping device can utilize a spring (not shown) loaded in the axial direction and that can apply a force against the face of the gun. The spring would function to allow the collet to move axially as a nozzle tip 4 is threaded on or off the plasma gun 10.

Figure 2:
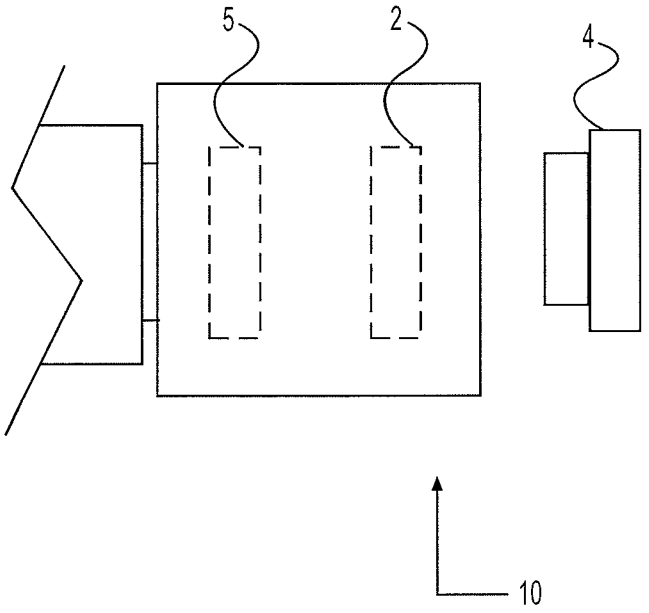
FIG. 2 shows a side schematic view of a mounted thermo spray gun and showing a nozzle tip removed therefrom in accordance with one non-limiting embodiment of the invention.
Figure 3:
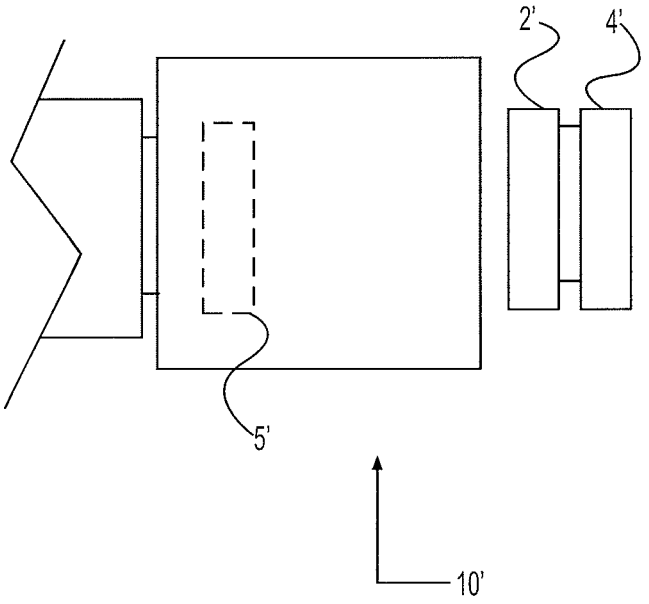
FIG. 3 shows a side schematic view of a mounted thermo spray gun and showing a nozzle tip arrangement (i.e., a nozzle tip and an anode section) removed therefrom in accordance with one non-limiting embodiment of the invention.

The embodiments of FIGS. 2 and 3 show an embodiment of the invention similar to that of FIG. 1 wherein the nozzle tip 4 is interchangeably removable and installable onto a plasma gun 10 and another embodiment wherein the nozzle tip 4' and an anode section 2' (which can be assembled or formed as an integral unit) is interchangeably removable and installable onto a plasma gun 10. In either of these embodiments, the plasma gun 10 can be mounted on a movable arm such as a robot arm.

Figure 4:
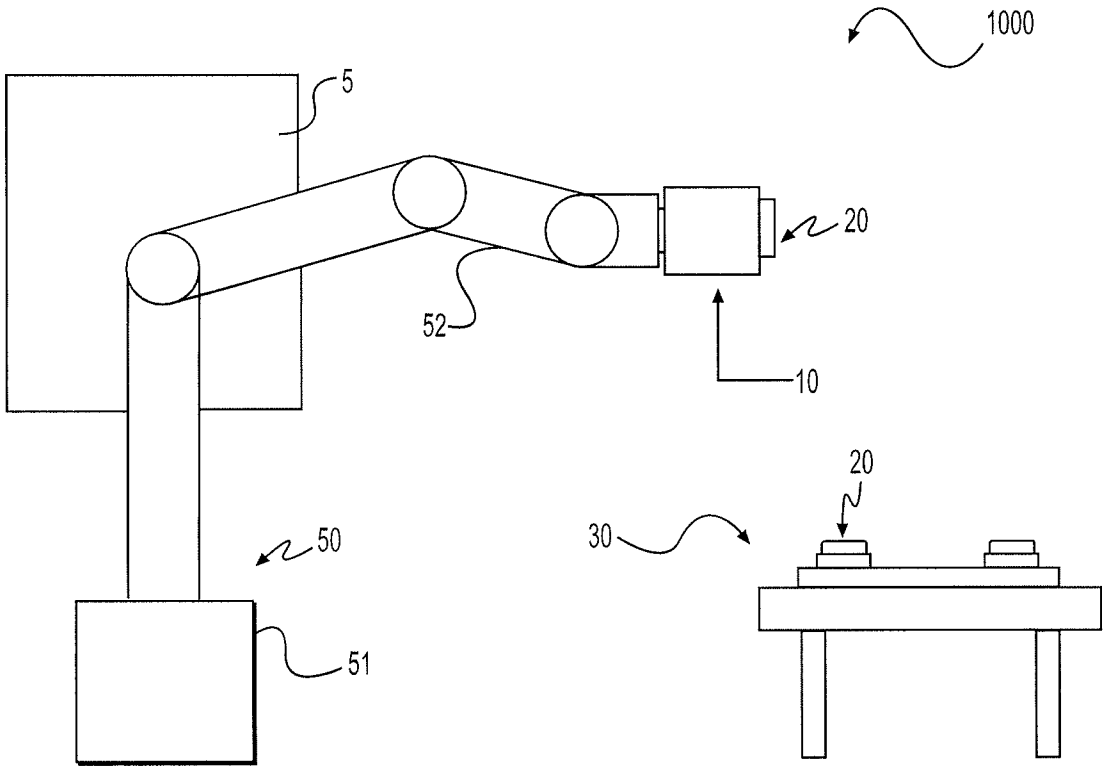
FIG. 4 shows a side schematic view of a coating area having a thermo spray system and showing a nozzle tip installed on the thermo spray gun in accordance with one non-limiting embodiment of the invention.
Figure 5:
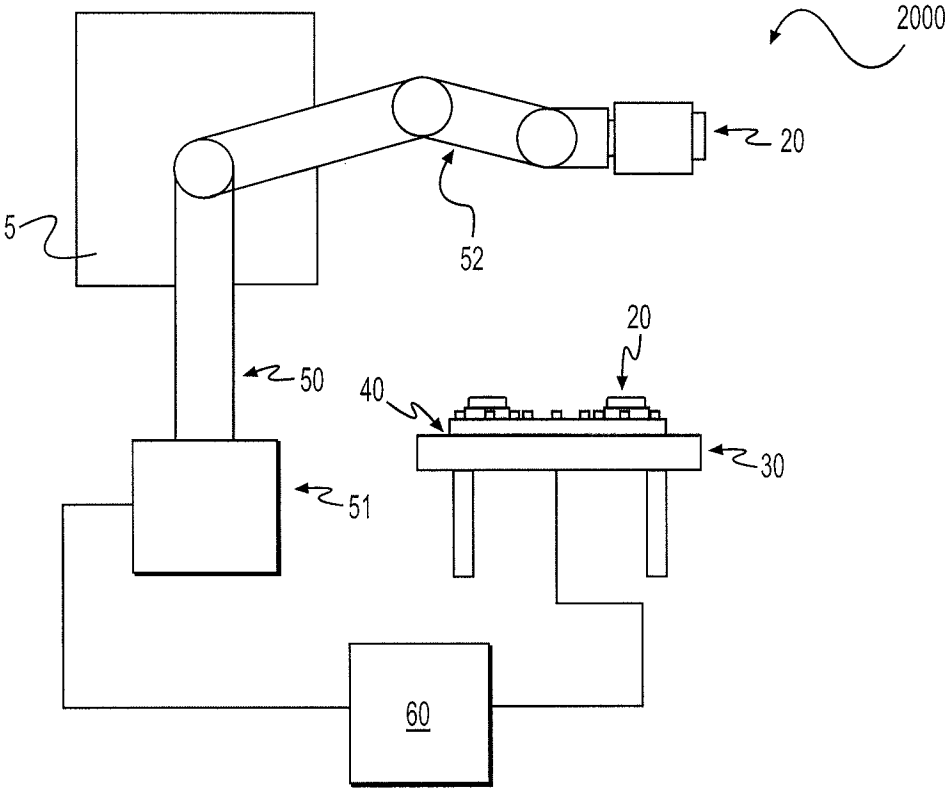
FIG. 5 shows a side schematic view of a coating area having a thermo spray system and a control, and showing a nozzle tip installed on the thermo spray gun in accordance with another non-limiting embodiment of the invention.
Figure 6:
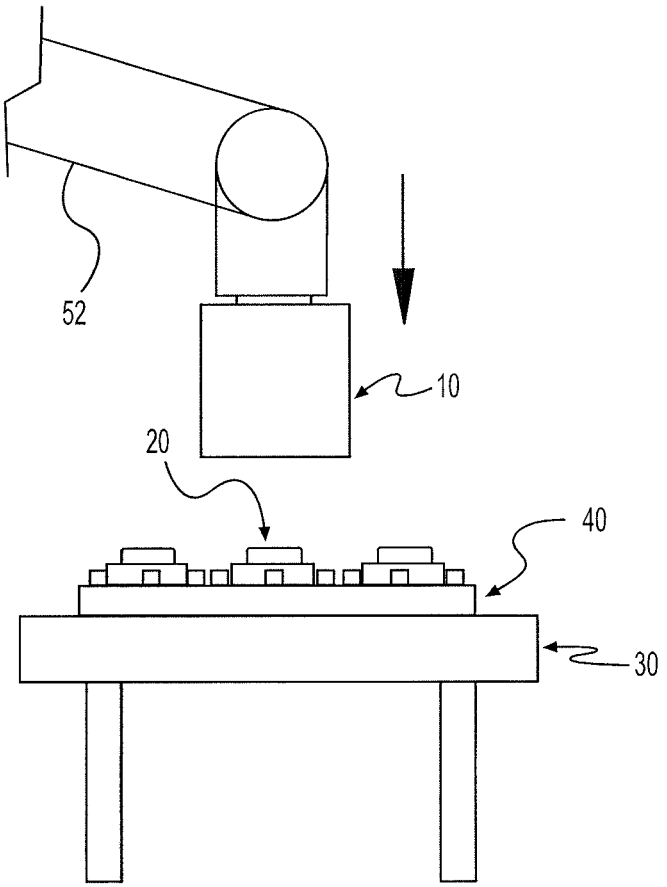
FIG. 6 shows a side schematic view of a thermo spray system and showing a thermo spray gun moving towards a station containing plural nozzle tips that can be installed thereon in accordance with one non-limiting embodiment of the invention.

With reference to FIG. 4, there is shown one non-limiting arrangement 1000 in which multiple nozzle tips can be located or stored on a support 30, e.g., a support table or fixture support table, in a spray booth station wherein a substrate S is located. In example of FIG. 4, the plasma gun 10 is mounted on a robot 50 having a base 51 and a robot arm 52. With such an arrangement 1000, the plasma gun 10 mounted on the arm 52 can move over to the support 30. Once positioned near the support 30, an operator can manually remove or install a nozzle tip 20 on the plasma gun 10 thereby transferring it from a stored configuration on the support 30 to an installed position on the plasma gun 10.

With reference to FIGS. 5-9, there is shown one non-limiting arrangement 2000 (see FIG. 5) in which multiple gripping devices 45 (see FIG. 7), i.e., collet and spindle devices, can be arranged on a fixture 40 positioned on a support 30 in a spray booth station wherein a substrate S is located. In the example of FIGS. 5-9, the plasma gun 10 is mounted on a robot 50 having a base 51 and a robot arm 52. With such an arrangement 2000, the plasma gun 10 mounted on the arm 52 can move over to the support 30. Once positioned over the fixture 40 and located over one of the gripping devices 45 arranged thereon, the gripping device 45 can remove or install a nozzle tip 20 on the plasma gun 10 thereby transferring it from a stored configuration on the fixture 40 to an installed position on the plasma gun 10. The movements of the robot 50 and gripping devices 45 can be controlled by a controller 60 which can be programmed to perform a coating process wherein at least one of the nozzle tips 20 is installed and/or removed from the plasma gun 10 by at least one of the gripping devices 45 of the fixture 40.

Figure 7:
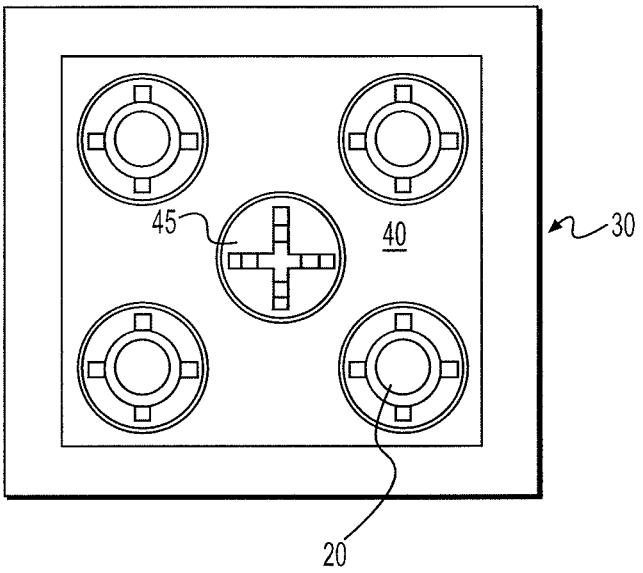
FIG. 7 shows a top view of the station shown in FIG. 6 but with one of the nozzle tips removed therefrom.
Figure 8:
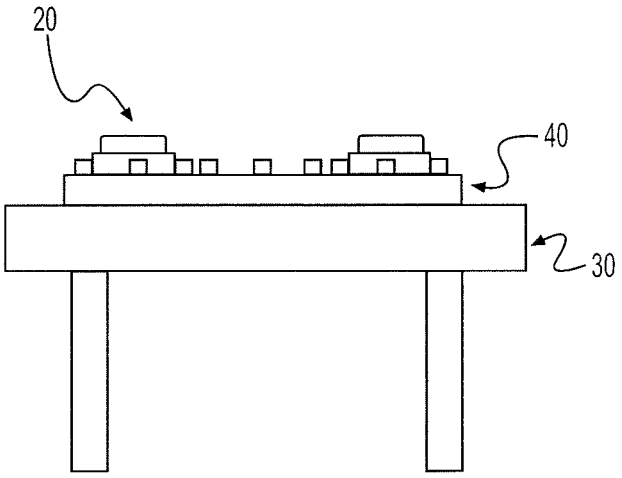
FIG. 8 shows a side view of the station of FIG. 7.
Figure 9:
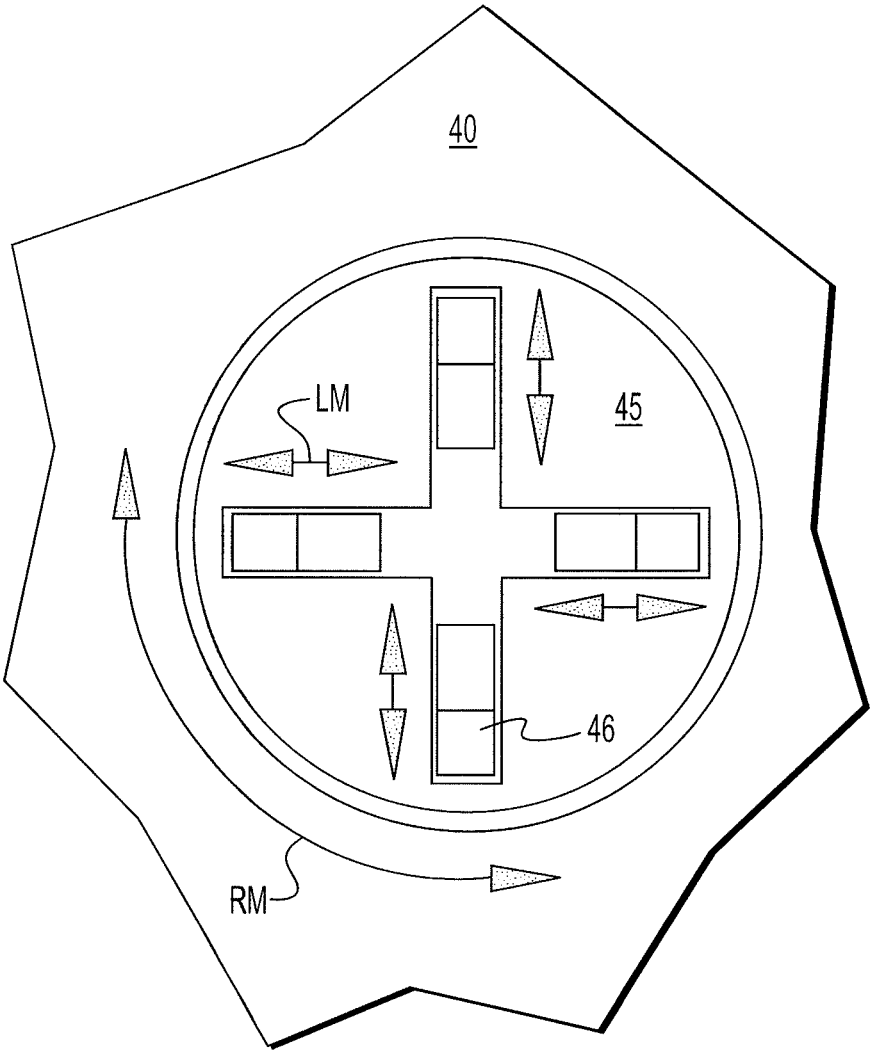
FIG. 9 shows an enlarged partial view of the station of FIG. 7. Arrows illustrating linear movement show how the gripping members of a chuck or collet can move in either a gripping direction or a releasing direction. The arrows illustrating rotational movement show how the chuck or collet can rotate in either an installing direction or an uninstalling (i.e., removing) direction.

With reference to FIGS. 7-9, there is shown one non-limiting fixture 40 having multiple gripping devices 45, i.e., collet and spindle devices, positioned on a support 30. Each gripping device 45 includes radially and/or linearly movable (along direction LM) gripping members 46 for griping the tip 20 (e.g., section 9 in FIG. 1) and can rotate in opposite, i.e., clockwise and counterclockwise, directions along rotation directions RM.

An exemplary way of utilizing the arrangement 2000 in FIGS. 5-9 is as follows: A plasma gun 10 with no nozzle tip is moved by the robot 50, via program commands, to one of the nozzle tip locations on the fixture 40 (see FIG. 6). Once at the fixture 40, one of the gripping devices 45 having a nozzle tip 20 gripped therein is rotated to thread the nozzle tip 20 into the nozzle base of the plasma gun 10 by program commands. Once the threads are seated (e.g., a surface of the collet contacts gun face) the gripping device 45 releases the nozzle tip 20. The plasma gun 10 then moves away from the fixture 40, is lit, and sprays a first material coating layer onto a substrate S via programmed commands. Then, the plasma gun 10 moves back to fixture 40 to the same position on the fixture 40 where the first nozzle insert was threaded onto the gun 10. The gripping device 45 grips (e.g., section 9 of the tip as shown in FIG. 1) the nozzle tip 20 and then unthreads the tip 10 from the nozzle base. The plasma gun 10 moves, via program commands, to position of another nozzle tip 20. The other gripping device 45 with the nozzle tip 20 retained thereon is rotated to thread the new nozzle tip 20 into the nozzle base by program commands. Once the threads are seated, the gripping device releases the nozzle tip 20. The plasma gun 10 then moves away from the fixture 40, is lit, and sprays a second material coating layer onto the substrate S via programmed commands. The process is repeated as many times as needed for the number of nozzle tip changes required to complete the coating process of the substrate S.

An exemplary fixture 40 as described can preferably handle, store or retain thereon almost any number of nozzle tips 20 (whether different or not) as is required for a specific job or process. The fixture 40 can also include as many different nozzle tips 20 as are available for the specific plasma gun.

Figure 10:
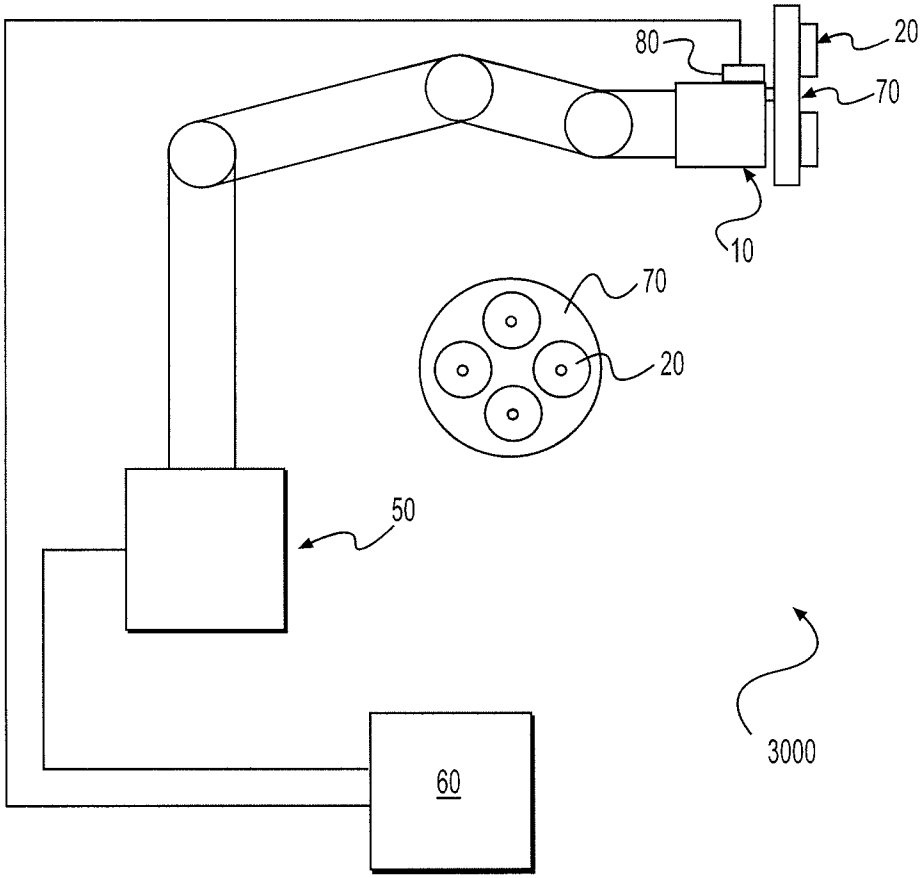
FIG. 10 shows a side schematic view of a thermo spray system utilizing a device which can move two or more nozzle tips into a spray position in accordance with one non-limiting embodiment of the invention. The drawing in the center is a view of the device when not installed on the thermo spray gun and orthogonal to the installed position shown in FIG. 10.

With reference to FIG. 10, there is shown another non-limiting arrangement 3000 in which nozzle tips 20 are arranged on a fixture 70 which can position each of the nozzle tips 20 into a spraying or alignment (the bore of the nozzle tip is placed into alignment with the bore of the plasma gun) position for spraying a coating with the plasma gun. As is evident from the view shown in the center of the drawing, the fixture 70 can have the form of a circular plate which contains multiple angularly spaced nozzle tips 20. Each nozzle tip 20 mounted to the plate 70 can be rotated into position by a motor 80 mounted in the vicinity of the plasma gun 10. The motor 80 and robot 50 can be controlled by a controller 60 which can be programmed to perform a coating process wherein at least one of the nozzle tips 20 is moved into alignment for spraying with the plasma gun 10 by the motor 80.

Although the embodiment of FIG. 10 shows an arrangement in which nozzle tips 20 are arranged on a rotatable fixture 70 which can positioned each of the nozzle tips 20 into spraying alignment with the plasma gun. 10, the invention also contemplates a rectangular plate which linearly or slidably moves the plate back and forth so as to place two or more, e.g., two or more different, nozzle tips 20 into spraying alignment with the plasma gun. 10. In either case, movement of the plate can also be effected via, e.g., pneumatically or electrically.

Figure 11:
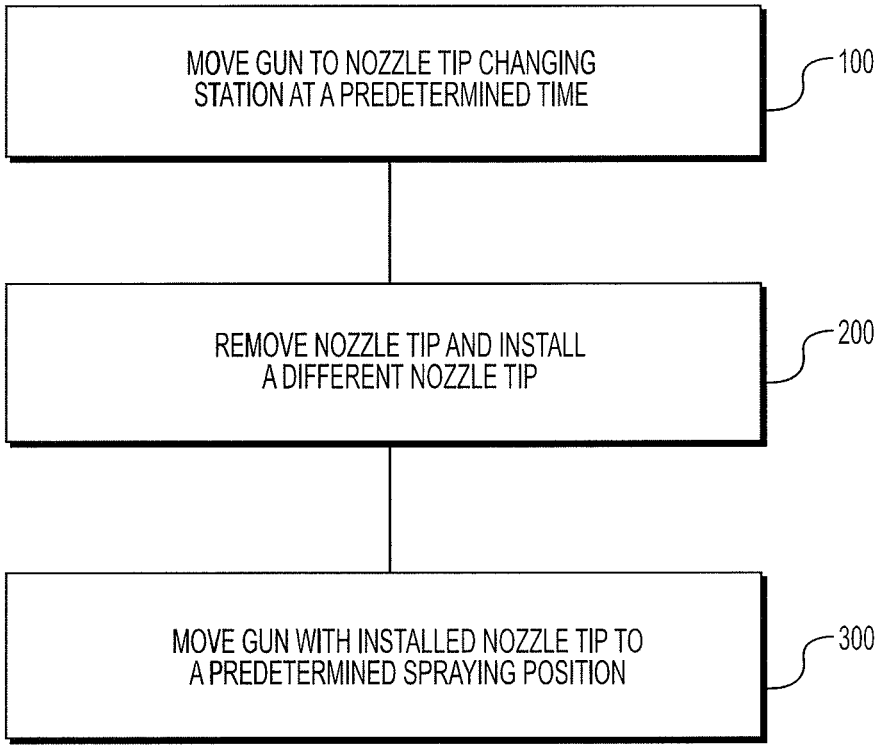
FIGS. 11-14 show flow charts illustrating different methods of using the thermo spray gun in accordance with non-limiting embodiments of the invention.

With reference to FIG. 11, there is shown one non-limiting method of changing a nozzle tip 4/20 in accordance with the invention. In step 100, the plasma gun 10 is moved to a nozzle tip changing station, e.g., location 30 in FIG. 4. This can preferably occur at a predetermined time in step 100. Then, in step 200, a nozzle tip 4/20 installed on the plasma gun 10 is removed and a new nozzle tip 20 is installed on the plasma gun 10. Next, in step 300, the plasma gun 10 is moved to a spraying position. This can preferably be at a predetermined spraying position in step 300.

Figure 12:
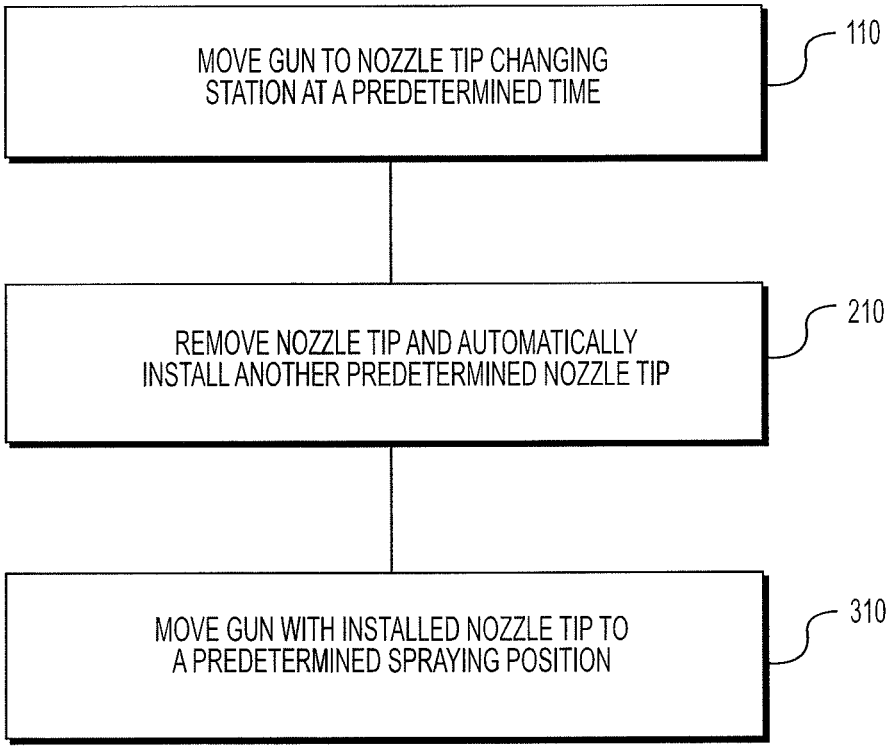

With reference to FIG. 12, there is shown another non-limiting method of changing a nozzle tip 4/20 in accordance with the invention. In step 110, the plasma gun 10 is moved to a nozzle tip changing station, e.g., location 30 in FIGS. 5 and 6. This can preferably occur at a predetermined time in step 110. Then, in step 210, a nozzle tip 4/20 installed on the plasma gun 10 is automatically removed and a new nozzle tip 20 is automatically installed on the plasma gun 10. Next, in step 310, the plasma gun 10 is moved to a spraying position. This can preferably be at a predetermined spraying position in step 310.

Figure 13:
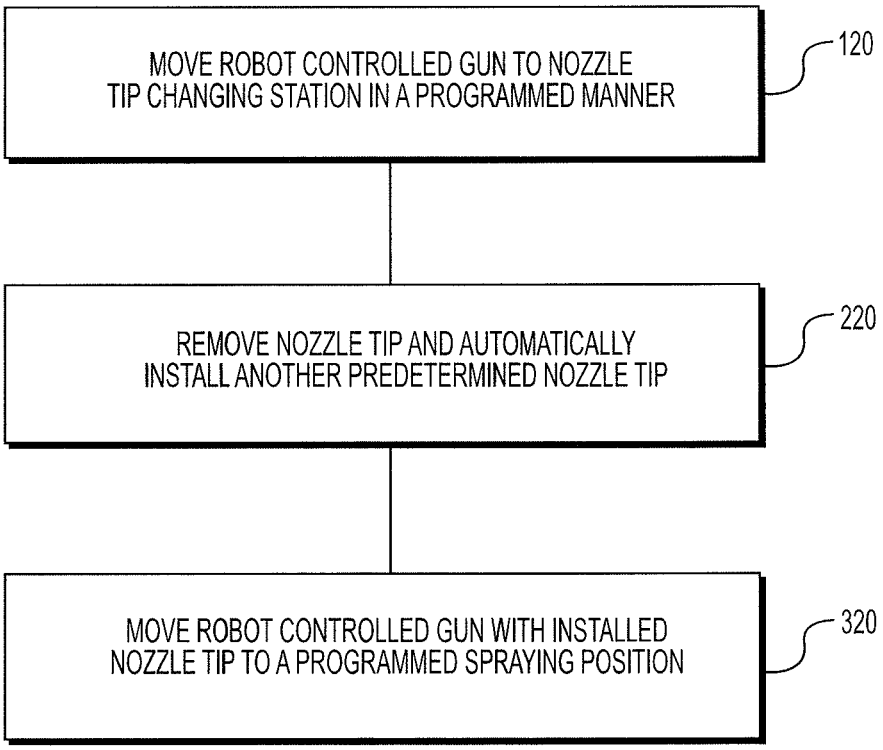

With reference to FIG. 13, there is shown another non-limiting method of changing a nozzle tip 4/20 in accordance with the invention. In step 120, the plasma gun 10 is arranged on a robot and is moved in a controlled manner to a nozzle tip changing station, e.g., location 30 in FIGS. 5 and 6. Then, in step 220, a nozzle tip 4/20 installed on the plasma gun 10 is automatically removed in a controlled manner and a new nozzle tip 20 is automatically installed on the plasma gun 10 in a controlled manner. Next, in step 320, the plasma gun 10 is moved to a spraying position in a controlled manner and the plasma gun 10 executes a spraying/coating process in a controlled manner.

Figure 14:
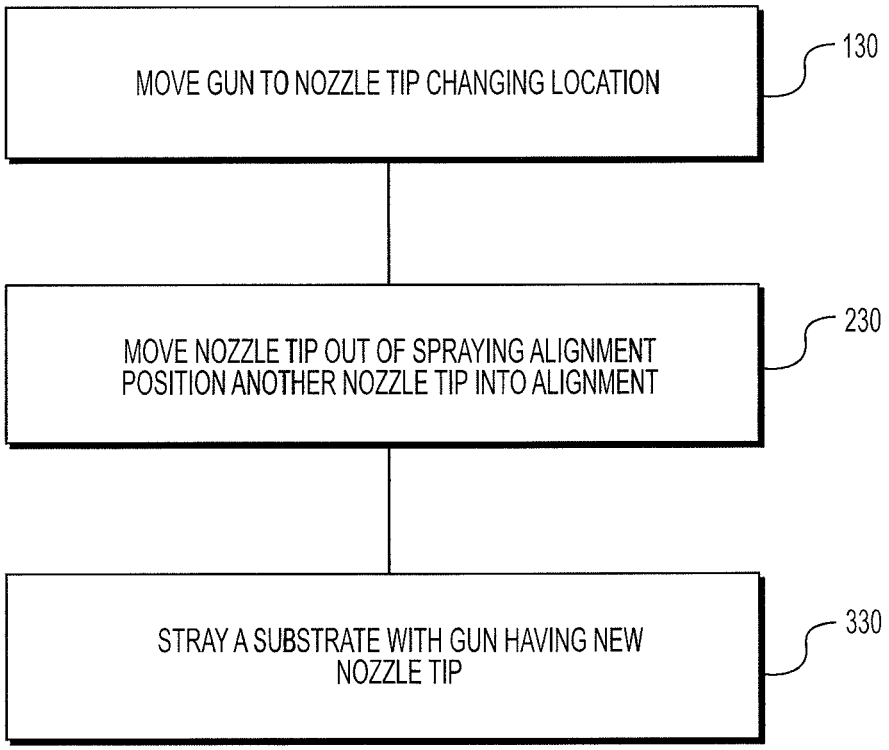

With reference to FIG. 14, there is shown still another non-limiting method of changing a nozzle tip 4/20 in accordance with the invention. In step 130, the plasma gun 10 is moved to a nozzle tip changing station. This can occur at a predetermined time in step 130. Then, in step 230, a nozzle tip 4/20 already in alignment with the plasma gun 10 is moved out of alignment and a new nozzle tip 20 is moved into alignment with the plasma gun 10. Next, in step 330, the plasma gun 10 is moved to a spraying position and sprays a substrate with a coating material. This method preferably is performed in an automated and/or controlled or preprogrammed manner.

It is noted that the materials and sizes for the nozzle tips can be similar to that used in known plasma guns which does not utilize interchangeable/removable nozzle tips.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and sprit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A thermal spray gun comprising an internal cathode section, an internal anode section, an internal arc attachment zone, and an internal cooling channel, and at least one interchangeable nozzle tip for spraying a coating material and that is removable while the internal anode section remains in place inside the thermal spray gun, wherein said nozzle tip has a connecting interface that extends inside the thermal spray gun and is installable via rotation in one direction and removable via rotation in an opposite direction, and wherein said nozzle tip is spaced from the cooling channel so that said nozzle tip does not come into contact with coolant from the cooling channel, wherein the nozzle tip comprises an engageable portion configured to be externally gripped while the cathode section and the anode section remain disposed inside the thermal spray gun and that, when installed, at least one of:

extends outside the thermal spray gun and is directly accessible from outside the thermal spray gun for removing, replacing and/or interchanging said nozzle tip by rotation of said nozzle tip and without manual disassembly of at least part of the thermal spray gun; and/or is directly grippable from outside the thermal spray gun for removing, replacing and/or interchanging said nozzle tip by rotation of said nozzle tip and without manual disassembly of at least part of the thermal spray gun.

2. The thermal spray gun of claim 1, wherein said nozzle tip is mechanically coupled to the anode section of the thermal spray gun.

3. The thermal spray gun of claim 1, wherein said nozzle tip is electrically coupled to the anode section of the thermal spray gun.

4. The thermal spray gun of claim 1, wherein said nozzle tip is removable from the thermal spray gun by unthreading while the anode section remains coupled to the thermal spray gun.

5. The thermal spray gun of claim 1, wherein said nozzle tip includes the anode section of the thermal spray gun.

6. The thermal spray gun of claim 1, wherein the thermal spray gun is one of a plasma spray gun and an HVOF spray gun.

7. The thermal spray gun of claim 1, further comprising at least one feedstock supply line coupled to a portion of the thermal spray gun.

8. The thermal spray gun of claim 1, further comprising a robot, wherein the thermal spray gun is mounted to an arm of the robot.

9. The thermal spray gun of claim 1, in combination with a station or location storing a plurality of nozzle tips.

10. The thermal spray gun of claim 1, in combination with a station or location storing a plurality of different nozzle tips.

11. The thermal spray gun of claim 1, in combination with a station or location storing a plurality of nozzle tips arranged at a predetermined location that is different from a location containing a substrate being sprayed with the coating material.

12. A method of coating a substrate using the thermal spray gun of claim 1, comprising:
- mounting at least one interchangeable nozzle tip on the thermal spray gun; and
- spraying a coating material with the at least one interchangeable nozzle tip.

13. A method of coating a substrate using the thermal spray gun of claim 1, comprising:
- removably mounting at least one interchangeable nozzle tip on the thermal spray gun; and
- spraying a coating material with the at least one interchangeable nozzle tip.

14. A method of coating a substrate using the thermal spray gun of claim 1, comprising:
- mounting at least one interchangeable nozzle tip on the thermal spray gun;
- spraying a coating material with the at least one interchangeable nozzle tip;
- removing the at least one interchangeable nozzle tip from the thermal spray gun; and
- mounting another at least one interchangeable nozzle tip on the thermal spray gun.

15. A method of coating a substrate using the thermal spray gun of claim 1, comprising:
- moving the thermal spray gun to a predetermined location; and
- mounting at least one interchangeable nozzle tip on the thermal spray gun.

16. A method of coating a substrate using the thermal spray gun of claim 1, comprising:
- spraying a coating material with the at least one interchangeable nozzle tip;
- moving the thermal spray gun to a predetermined location; and
- removing the at least one interchangeable nozzle tip from the thermal spray gun.

17. A method of coating a substrate using the thermal spray gun of claim 1, comprising:
- automatically moving the thermal spray gun of to a predetermined location; and
- automatically removing the at least one interchangeable nozzle tip from the thermal spray gun.

18. A method of coating a substrate using the thermal spray gun of claim 1, comprising:
- automatically moving the thermal spray gun to a predetermined location; and
- automatically installing at least one interchangeable nozzle tip onto the thermal spray gun.

19. A method of coating a substrate using the thermal spray gun of claim 1, comprising:
- automatically moving the thermal spray gun to a predetermined location;
- automatically removing the at least one interchangeable nozzle tip onto the thermal spray gun; and
- automatically installing another at least one interchangeable nozzle tip onto the thermal spray gun.

20. A method of coating a substrate using the thermal spray gun of claim 1, comprising:
- spraying a coating material with the at least one interchangeable nozzle tip;
- moving the thermal spray gun to a predetermined location;
- removing the at least one interchangeable nozzle tip onto the thermal spray gun;
- installing an other at least one interchangeable nozzle tip onto the thermal spray gun; and
- spraying a coating material with the other at least one interchangeable nozzle tip.

21. A method of coating a substrate using the thermal spray gun of claim 1, comprising:
- spraying in a controlled manner a coating material with the at least one interchangeable nozzle tip;
- moving in a controlled manner the thermal spray gun to a predetermined location;
- removing in a controlled manner the at least one interchangeable nozzle tip onto the thermal spray gun;
- installing in a controlled manner an other at least one interchangeable nozzle tip onto the thermal spray gun; and
- spraying in a controlled manner a coating material with the other at least one interchangeable nozzle tip.

22. A method of coating a substrate using the thermal spray gun of claim 1, comprising:
- spraying a coating material with the at least one interchangeable nozzle tip;
- automatically moving the thermal spray gun to a predetermined location;
- automatically removing the at least one interchangeable nozzle tip onto the thermal spray gun;
- automatically installing an other at least one interchangeable nozzle tip onto the thermal spray gun; and
- spraying a coating material with the other at least one interchangeable nozzle tip.

23. A thermal spray gun comprising:
- an internal cathode section;
- an internal anode section having at least one cooling channel;
- at least one interchangeable nozzle tip for spraying a coating material spaced from the at least one cooling channel so that said nozzle tip does not come into contact with coolant from the cooling channel;
- said nozzle tip being axially movable relative to the internal anode section during removal of said nozzle tip;

said nozzle tip, when installed on the thermal spray gun, comprising:

a rear portion that is surrounded by a portion of the at least one cooling channel; and a front portion extending in front of the internal anode section;

said nozzle tip having a connecting interface that extends inside the thermal spray gun and is installable via rotation in one direction and removable via rotation in an opposite direction, wherein the nozzle tip comprises an engageable portion configured to be externally gripped while the cathode section and the anode section remain disposed inside the thermal spray gun and that, when installed, at least one of:

said nozzle tip extends outside the thermal spray gun and is directly accessible from outside the thermal spray gun for removing, replacing and/or interchanging said nozzle tip by rotation and without manual disassembly of at least part of the thermal spray gun; and/or said nozzle tip is directly grippable from outside the thermal spray gun for removing, replacing and/or interchanging said nozzle tip by rotation and without manual disassembly of at least part of the thermal spray gun.

24. The thermal spray gun of claim 23, wherein said nozzle tip is removable while the internal anode section remains in place inside the thermal spray gun.

25. A thermal spray gun comprising an internal cathode section, an internal anode section having an arc attachment zone and an internal cooling channel, and at least one interchangeable nozzle tip for spraying a coating material and that is located in front of the arc attachment zone and removable while the internal anode section remains in place inside the thermal spray gun, wherein said nozzle tip has a connecting interface that that is spaced from the arc attachment zone, extends inside the thermal spray gun and is installable via rotation in one direction and removable via rotation in an opposite direction, wherein said nozzle tip is spaced from the cooling channel so that said nozzle tip does not come into contact with coolant from the cooling channel; and wherein the nozzle tip comprises an engageable portion configured to be externally gripped while the cathode section and the anode section remain disposed inside the thermal spray gun and that, when installed, at least one of:

extends outside the thermal spray gun and is directly accessible from outside the thermal spray gun for removing, replacing and/or interchanging said nozzle tip by rotation of said nozzle tip and without manual disassembly of at least part of the thermal spray gun; and/or is directly grippable from outside the thermal spray gun for removing, replacing and/or interchanging said nozzle tip by rotation of said nozzle tip and without manual disassembly of at least part of the thermal spray gun.

* * * * *